United States Patent [19]

Koshizuka et al.

[11] Patent Number: 4,925,735

[45] Date of Patent: May 15, 1990

[54] RESIN COMPOSITION FOR HEAT-SENSITIVE TRANSFER RECORDING MEDIUM AND HEAT-SENSITIVE TRANSFER RECORDING MEDIUM

[75] Inventors: Kunihiro Koshizuka; Masao Asano; Toshiaki Tezuka; Tatsuichi Maehashi; Yasuhiko Tanaka, all of Hino, Japan

[73] Assignee: Konishiroku Photo Industry Co., Ltd., Tokyo, Japan

[21] Appl. No.: 267,692

[22] Filed: Nov. 2, 1988

Related U.S. Application Data

[63] Continuation of Ser. No. 76,388, Jul. 22, 1987, abandoned.

[30] Foreign Application Priority Data

Jul. 29, 1986 [JP] Japan ..... 61-178375
Jan. 29, 1987 [JP] Japan ..... 62-19038

[51] Int. Cl.[5] ..... B41M 5/26

[52] U.S. Cl. ..... 428/423.1; 428/195; 428/447; 428/474.4; 428/480; 428/484; 428/488.4; 428/500; 428/532; 428/913; 428/914

[58] Field of Search ..... 428/195, 447, 484, 488, 428/488.4, 913, 914, 423.1, 474.4, 480, 500, 532; 503/227

[56] References Cited

U.S. PATENT DOCUMENTS 4,559,273 12/1985 Kutsukake et al. ..... 428/480

FOREIGN PATENT DOCUMENTS 138483 4/1985 European Pat. Off. ..... 428/488.4
143152 11/1979 Japan ..... 428/488.4
7467 1/1980 Japan ..... 428/488.4
155794 12/1981 Japan ..... 428/488.4
74195 5/1982 Japan ..... 428/488.4
129789 8/1982 Japan ..... 428/488.4
94391 5/1985 Japan ..... 428/488.4
219096 11/1985 Japan ..... 428/488.4

*Primary Examiner*—Pamela R. Schwartz
*Attorney, Agent, or Firm*—Frishauf, Holtz, Goodman & Woodward

[57] ABSTRACT

Disclosed is a resin composition for heat-sensitive transfer recording medium, comprising (A) a silicone resin and (B) at least one resin selected from the group consisting of polyester resins, polyamide resins, cellulose type resins and acrylic resins.

Disclosed is also a heat-sensitive transfer recording medium having at least one colorant layer containing a heat-fusible substance on a support, comprising a backing layer formed from (A) a silicone resin and (B) at least one resin selected from the group consisting of polyester resins, polyamide resins, cellulose type resins and acrylic resins provided on the surface of the support where no colorant layer is provided.

The resin composition for heat-sensitive transfer recording medium of the present invention has sufficient heat resistance.

Also, the heat-sensitive transfer recording medium utilizing the resin composition for heat-sensitive transfer recording medium as a backing layer is free from generation of blocking phenomenon between the backing layer and a colorant layer even when stored for a long term under wound state, contamination of thermal head, generation of sticking phenomenon, transfer irregularity of a colorant layer and printed image defect.

17 Claims, No Drawings

RESIN COMPOSITION FOR HEAT-SENSITIVE TRANSFER RECORDING MEDIUM AND HEAT-SENSITIVE TRANSFER RECORDING MEDIUM

This application is a continuation of application Ser. No. 07/076,388, filed Jul 22, 1987 now aband.

BACKGROUND OF THE INVENTION

This invention relates to a resin composition for heat-sensitive transfer recording medium and a heat-sensitive transfer recording medium utilizing the resin composition for heat-sensitive transfer recording medium.

In the prior art, a heat-sensitive transfer recording medium comprises a colorant layer containing a fusible substance formed on the surface of a lengthy substrate sheet formed of, for example, a polyester. In most cases, the heat-sensitive transfer recording medium is shipped and stored under wound state. And, the heat-sensitive transfer recording medium under wound state, by, for example, heating the surface opposite to that of the substrate sheet where the above colorant layer is provided, melts a part of the above colorant layer and transfers the melted colorant layer onto the surface of a recording sheet such as paper in contact with the heat-sensitive transfer recording medium, thereby forming a printed image on the surface of the above paper.

However, in the heat-sensitive transfer recording medium of the prior art, in the case of performing heat-sensitive transfer with a thermal head, when transfer is effected with a thermal energy necessary to obtain sufficient printed image density, the so-called sticking phenomenon is caused in which the substrate sheet itself is fused to the thermal head, whereby there are involved problems such that running of the heat-sensitive transfer recording medium becomes impossible or that the heat-sensitive transfer recording medium is broken at that portion in an extreme case.

Also, since the heat-sensitive transfer recording medium of the prior art is stored under wound state as mentioned above, during storage thereof for a long term, the so-called blocking phenomenon may sometimes occur in which the back of the substrate sheet is adhered to the colorant layer. If blocking phenomenon has occurred, it becomes impossible to withdraw the heat-sensitive transfer recording medium under wound state for running.

For solving these problems, some attempts for providing heat-resistant protective layer as the backing layer on the back of the substrate sheet have been proposed.

For example, there have been proposed the method in which a metal layer or a silicon oxide layer as an abrasion resistant layer is provided on the back of the substrate sheet (see Japanese Unexamined Patent Publication No. 143152/1979 and No. 74195/1982), the method in which a heat-resistant resin layer such as of silicone or fluorine is provided (see Japanese Unexamined Patent Publication No. 7467/1980), the method in which a resin layer added with solid or semi-solid surfactant at normal temperature is provided (see Japanese Unexamined Patent Publication No. 129789/1982), or the method in which a layer containing a lubricating inorganic pigment in a heat-resistant resin is (see Japanese Unexamined Patent Publication No. 155794/1981).

However, the methods according to such proposals involve problems in that prevention of sticking phenomenon or prevention of blocking phenomenon is not satisfactory, or that special means requiring great production cost such as vapor deposition, cure aging, etc. may be necessary.

Also, the heat-sensitive transfer recording medium merely coated on the back of the substrate sheet with a heat-resistant resin layer such as of silicone or fluorine will be denatured in the colorant layer through migratability of the silicone or fluorine material itself, during storage for a long term or after exposed for a long time under high temperature. It has now been clarified by the study by the present inventors that transfer irregularity and defect of printed image are caused by receiving bad influences on the colorant layer from the migratable heat-resistant resin layer.

The present invention has been accomplished on the basis of the state of the art as described above.

SUMMARY OF THE INVENTION

That is, an object of the present invention is to provide a resin composition for heat-sensitive transfer recording medium which can prevent generation of sticking phenomenon and blocking phenomenon and a heat-sensitive transfer recording medium utilizing the resin composition for heat-sensitive transfer recording medium.

Another object of the present invention is to provide a less expensive heat-sensitive transfer recording medium, which requires no production cost such as for cure aging, etc.

Still another object of the present invention is to provide a resin composition for heat-sensitive transfer recording medium capable of transferring constantly sharp printed images without migratability to the colorant material even when stored under the state of a wound product for a long term or under high temperature condition and a heat-sensitive transfer recording medium utilizing the resin composition for heat-sensitive transfer recording medium as the backing layer.

A first gist of the present invention for solving the problems is a resin composition for heat-sensitive transfer recording medium, comprising (A) a silicone resin and (B) at least one resin selected from the group consisting of polyester resins, polyamide resins, cellulose type resins and acrylic resins.

A second gist of the present invention is a heat-sensitive transfer recording medium having at least one colorant layer containing a heat-fusible substance on a support, comprising a backing layer formed from (A) a silicone resin and (B) at least one resin selected from the group consisting of polyester resins, polyamide resins, cellulose type resins and acrylic resins provided on the surface of said support where no colorant layer is provided.

In the present invention, the above composition should further preferably contain a polyisocyanate compound, and further the backing layer in the above heat-sensitive transfer recording medium should be formed of a composition containing a polyisocyanate compound.

DETAILED DESCRIPTION OF THE INVENTION

Next, the resin composition for heat-sensitive transfer recording medium is first described.

As the above silicone resin which is the component (A) as herein mentioned, in addition to compounds which are so-called organopolysiloxanes, having siloxane bond and also alkyl group such as methyl group on silicon atom (see the formula shown below),

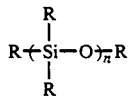

there can be employed modified polysiloxane resins having various modifications applied to the above alkyl group such as epoxy modification, olefin modification, ether modification, alcohol modification, fluorine modification, amino modification, mercapto modification and carboxyl modification as well as resins in which a part of urethane resins, acrylic resins and polyester resins is subjected to silicone modification with the above polysiloxane (preferably those with the silicone moiety comprising 5 to 40% by weight of the whole resin).

Examples of the structural formulae of the above modified polysiloxane resin are shown below.

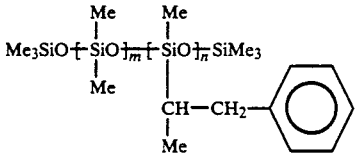

(1)

-continued

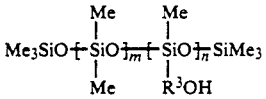

(5)

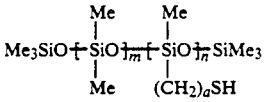

(6)

[In the above formulae, m, n, a, b, c and x are integers of 0 or more, m and n cannot be 0 at the same time, $R^1$ represents an alkyl group, $R^2$ and $R^3$ each represent a divalent bonding group, and Me represents a methyl group].

Among various silicone resins as mentioned above, those having softening point (according to ASTM D 1525) of 60° C. or higher, preferably 80° C. or higher, are desirable.

In the present invention, among these silicone resins, silicone modified urethane resins in which a part of the urethane resin is modified with the above organopolysiloxane or a modified polysiloxane resin are most preferred.

Among the silicone modified resins as mentioned above, preferable specific examples are shown below, by which the present invention is not limited at all.

Formula (1)

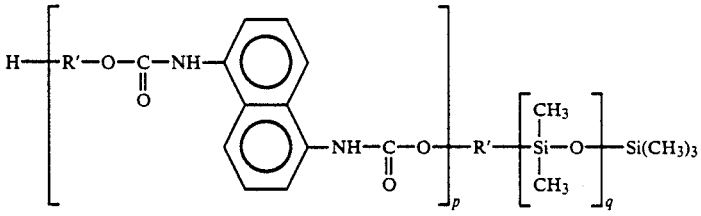

(2) (wherein p and q represent integers)

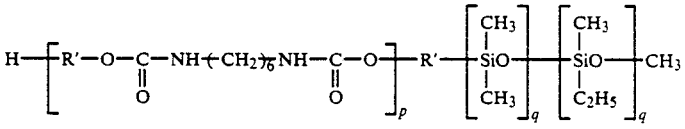

(wherein p and q have the same meanings as above and r represents an integer).

In the formulae, $R^1$ represents the formulae (3) to (6).

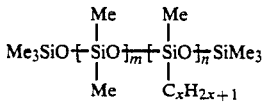

(3)

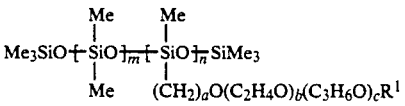

(4)

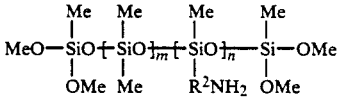

Formula (3)

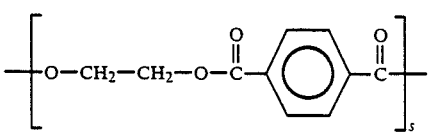

(wherein s represents an integer)

Formula (4)

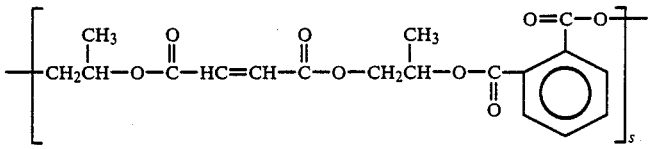

(wherein s represents the same meaning as above)

Formula (5)

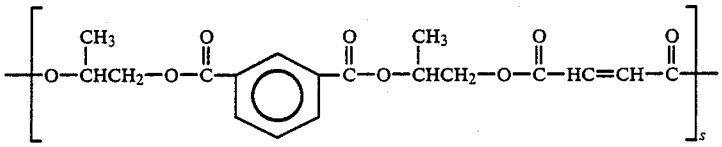

(wherein s represents the same meaning as above)

Formula (6)

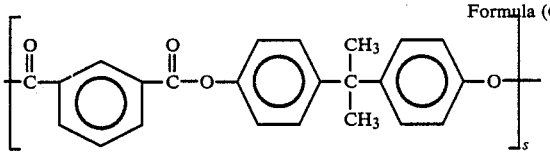

(wherein s represents the same meaning as above).

The weight ratio of the urethane resin moiety (X) to the silicone resin moiety (Y) (X:Y) in the above silicone modified urethane resin may be generally 99:1 to 5:95 (preferably 95:5 to 10:90).

Next, the specific resin which is the above component (B) is at least one resin selected from the group consisting of polyester resins, polyamide resins, cellulose type resins and acrylic resins.

As the above polyester resin, any of those generally called thermoplastic polyester resins, including also copolymers, can be used without particular limitation, but those having molecular weights of 5,000 to 100,000, particularly 10,000 to 20,000 are preferred, and those having softening points (according to the same test standard as mentioned above) of 70° C. or higher, particularly 100° C. or higher, are preferred. Further, those having tensile strength at break (ASTM D 638-61T) of 400 kg/cm$^2$ or higher when molded into film are preferred.

The above polyamide resin is not particularly limited, but, for example, nylon 6, nylon 8, nylon 11, nylon 66 and nylon 610 may be included. Otherwise, copolymers can be also used.

Among various polyamides, polyamide resins having molecular weights of 10,000 or higher and softening points (according to the same test standard as mentioned above) of 70° C. or higher, particularly 110° C. or higher are preferred.

Examples of the above cellulose type resin may include cellulose esters such as acetyl cellulose, nitrocellulose, acetyl butyl cellulose, etc., cellulose ethes such as ethyl cellulose, methyl cellulose, benzyl cellulose and carboxymethyl cellulose.

As the above acrylic resin, there may be included, for example, homopolymers of methyl acrylate, ethyl acrylate, methyl methacrylate, ethyl methacrylate, acrylonitrile, acrylamide and derivatives thereof as well as copolymers of the above various acrylic monomers with vinyl acetate, vinyl chloride, styrene or maleic anhydride.

Among various acrylic resins, those having molecular weights of 5,000 to 700,000, particularly 10,000 to 50,000 are preferred, and also those having softening points (according to the same test standard as mentioned above) of 70° C. or higher, particularly 90° C. or higher are preferred.

Particularly in the present invention, among these components (B), the cellulose type resin is preferable and further, among cellulose type resins, nitrocellulose is particularly preferred.

In the above resin composition for heat-sensitive transfer recording medium, the above component (A) and the component (B) should be preferably contained each in an amount of 10% by weight or more.

As the preferable formulation ratio of the silicone resin which is the component (A) and the above component (B), the component (A)/the component (B) (weight ratio) should be desirably 80/20 to 10/90, particularly 60/40 to 15/85.

The resin composition for heat-sensitive transfer recording medium of the present invention can further contain a polyisocyanate compound.

The polyisocyanate compound available in the present invention may include aromatic polyisocyanate compounds, alicyclic polyisocyanate compounds and aliphatic polyisocyanate compounds, etc.

Examples of the aromatic polyisocyanate compound to be used in the present invention may include tolylene diisocyanate (TDI), 4,4'-diphenylmethane diisocyanate (MDI), xylylene diisocyanate (XDI), metaxylylene diisocyanate (MXDI) and adducts of these polyisocyanates with active hydrogen compounds, with average molecular weight being preferably within the range from 100 to 3,000.

Specific examples may include those with trade names produced by Sumitomo Bayern Urethane K.K.: Sumidule T80, 44S, PF and L and Desmodule T65, R, RF, IL and SL; those with trade names produced by Takeda Chemical Industries K.K.: Takenate 300S and 500; those with trade names produced by Mitsui Nisso Urethane K.K.: "NDI" and "TODI; those with trade names produced by Nippon Polyurethane K.K.: Desmodule T100, Millionate MR and MT and Coronate L; those with trade names produced by Kasei Upjohn Co.: PAPI-135, TDI65, 80 and 100, Isonate 125M and 143L, etc.

On the other hand, as the aliphatic polyisocyanate compound, there may be included hexamethylene diisocyanate (HMDI), lysine isocyanate, trimethylhexamethylene diisocyanate (TMDI) and adducts of these polyisocyanate compounds with active hydrogen compounds, etc.

Among these aliphatic polyisocyanate compounds and the adducts of these polyisocyanate compounds with active hydrogen compounds, preferred are those having molecular weights ranging from 100 to 3,000. Further, among aliphatic polyisocyanate compounds, non-cyclic polyisocyanate compounds and adducts of these compounds with active hydrogen compounds are preferred.

Specifically, for example, there are those with trade names produced by Sumitomo Bayern Urethane K.K.: Sumidule N, Desmodule Z-4273; those with trade names produced by Asahi Kasei K.K.: Duranate 50M and 24A-90CX; those with trade names produced by Nippon Polyurethane K.K.: Coronate HL and those with trade names produced by Huls Kagaku Co.: TMDI, etc.

On the other hand, as alicyclic polyisocyanate compounds among aliphatic polyisocyanate compounds, there may be included, for example:

methylcyclohexane-2,4-diisocyanate

[structural formula: 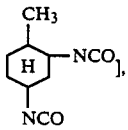

], 4,4-methylenebis(cyclohexylisocynate

[structural formula: 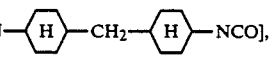

], isophorone diisocyanate and adducts of these polyisocyanates compounds with active hydrogen compounds.

Specific examples may include those with trade names produced by Huls Kaqaku Co.: IPDI, IPDI-T-1890, H2921, B1065, etc.

The amount of the polyisocyanate compound used may be generally within the range from 1 to 50% by weight based on the total weight of the above component (A) and the component (B). If it is less than 1% by weight, curing is liable to be insufficient, while slipping characteristic may be sometimes worsened if it is greater than 50% by weight. Further, it is preferable to set the amount of the polyisocyanate compound within the range from 1 to 20% by weight.

In the present invention, the plyisocyanate compound may be used singly or two or more kinds may be used in combination. Especially, by use of an aromatic polyisocyanate compound in combination with another poyisocyanate compound, curing speed can be controlled. In this case, the mixing ratio of the aromatic polyisocyanate compound may be set generally within the range from 20 to 80% by weight based on the total weight of the polyisocyanate compounds employed.

Also, as the curing accelerator, organic metals (e.g. cobalt naphthenate, tetra-n-butyl tin), inorganic metal salts (e.g. stannic chloride) or organic amines (e.g. methylamine) may be employed.

The backing layer of the present invention may also contain, in addition to the above components, other additives such as waxes, surfactants, higher fatty acid derivatives, higher aliphatic alcohols, higher aliphatic ethers and phosphoric acid esters, etc. (Component C).

Examples of the above waxes may include paraffin waxes such as paraffin wax, microwax, polyethylene wax, etc.; natural waxes such as beeswax, carunauba wax, tallow fatty acid, wood wax, etc.; ester type waxes such as Hoechst wax, etc. Among them, preferred is paraffin wax.

As the above surfactant, any of nonionic surfactants, cationic surfactants, anionic surfactants and amphoteric surfactants may be available, but nonionic surfactants are preferred.

Nonionic surfactants may include polyoxyethylene oleyl ether, polyoxyethylene cetyl ether, polyoxyethylene stearyl ether, polyoxyethylene lauryl ether, polyoxyethylene nonylphenyl ether, polyoxyethylene octylphenol ether, polyoxyethylene monolaurate, polyoxyethylene monostearate, polyoxyethylene monooleate, polyoyethylene glycol, sorbitane monolaurate, sorbitane monopalminate, sorbitane monostearate, sorbitane monooleate, sobitane sesquioleate, sorbitane trioleate, polyoxyethylene sorbitane monolaurate, polyoxyethylene sorbitane monostearate, polyoxyethylene sorbitane monooleate, oxyethylene oxypropylene block polymer, glycerol monostearate, polyoxyethylene distearate, etc.

Examples of the above higher fatty adic derivative may include higher fatty acids such as stearic acid, palmitic acid, behenic acid, myristic acid, 1,20-eicosane diacid, etc.; higher fatty acid amide such as stearoamide, oleoamide, palmityloamide, etc.; higher fatty acid esters such as butyl stearate, ethyl palmitate, myristyl stearate, etc.; metal salts of the above higher fatty acids with sodium, potassium, magnesium or zinc.

Examples of the above aliphatic alcohol may include higher alcohols such as stearyl alcohol, palmityl alcohol, behenyl alcohol, myristyl alcohol, marganyl alcohol, eicosanol and the like.

As the above higher aliphatic ether, there may be included monoesters of the above various higher aliphatic alcohols with xylytol, pentaerythritol, propylene glycol, glycerine or butyl alcohol, etc. or monoesters or polyesters, typically diesters with butyl alcohol, etc.

As the above phosphoric acid ester, for example, there may be included dipolyoxyethylene dodecyl ether phosphate, trioxyethyelene dodecyl ether phosphaate, glycerine phosphate, polyglycerine phosphate, etc.

These various components may be used either as a single kind or two or more kinds may be formulated.

The amount formulated may be generally 1 to 20% by weight, peferably 1 to 9% by weight, in the backing layer in the resin composition for heat-sensitive transfer recording medium or heat-sensitive transfer recording medium.

The above heat-sensitive transfer recording medium and the backing layer may also contain one or two or more of thermoplastic resins, thermosetting resins, waxes, surfactants and inorganic fine particles, other than the above component (A), the component (B) and, if necessary, the above component (C).

Examples of the above thermoplastic resin may include thermoplastic polyester resins, acrylic copolymer resins, polyamide resins, polyacrylamide, polyvinyl alcohol, phenoxy resins, etc.

On the other hand, as the above thermosetting resin, phenoxy resins, polyurethane, phenol resins, alkyd resins may be employed.

As the above wax, natural wax such as microwax and synthetic wax such as paraffin wax, Fischer-Tropsch wax may be included.

As the above surfactant, there may be included nonionic surfactants such as esters or ether derivatives of polyhydric alcohols (polyoxyethylene, glycerine, polyglycerine, sorbitane, etc.) or ester or amide derivatives of higher fatty acids, or ether or ester derivatives of higher alcohols, cationic surfactants and anionic surfactants, nonionic surfactants being preferred.

The above inorganic fine particles may be exemplified by calcium carbonate, talc, clay, mica, silica gel, metal powder, etc.

The amount of these thermoplastic resins, thermosetting resins and inorganic fine particles formulated can be determined experimentally suitable within the range which does not interfere with the object of the present invention.

The resin composition for heat-sensitive transfer recording medium according to the present invention is a mixture comprising the above components (A) and (B), the component (C) if necessary, and further the above thermoplastic resin, thermosetting resin and/or inorganic fine particles which are to be formulated as desired. The resin composition for heat-sensitive transfer recording medium is provided by coating on the support surface of a heat-sensitive transfer recording medium to become a backing layer.

The thickness of the backing layer in the present invention may be any desired thickness of 0.01 μm or more. Practically, a thickness of 0.03 to 1.0 μm is preferred.

The film support to be used in the present invention may be a resin film excellent in surface smoothness and dimensional stability, including specifically resin films such as polyethylene terephthalate film, polyamide film, polycarbonate film (including polymers, copolymers, terpolymers). The thickness of the film support is not limited, but preferably about 2 to 15 μm. These supports may be applied with electrical shock treatment such as corona charging, glow discharging, or others, flame treatment, UV-ray irradiation treatment, oxidation treatment, saponification treatment, surface roughening treatment, etc. in order to enhance adhesiveness of the backing layer, or may be applied with subbing working.

As the method for coating of the backing layer of the present invention on the film support, there is, for example, the method in which a coating solution having the above backing layer composition dispersed in a solvent is subjected to solvent coating. As the solvent to be used in this case, any solvent which can dissolve or disperse the respective components of the present invention to become a coating solution may be used, for example, organic solvents including paraffinic solvents such as n-hexane, ligroin, isoparaffin, etc.; aromatic solvents such as toluene, xylene, etc.; ketone solvents such as acetone, methyl ethyl ketone, methyl isobutyl ketone, etc.; alcohol solvents such as methanol, ethanol, propanol, butanol, etc.; ester solvents such as ethyl acetate, etc.; special solvent such as dimethylformamide, dimethyl sulfoxide, etc. Solvent mixtures of these may be also employed.

In carrying out coating, any desired coating technique such as the reverse roll coater method, the extrusion coater method, the gravure coater method, the wire bar coating method may be available.

The heat-sensitive transfer recording medium has at least one colorant layer formed on the surface of the support layer on the side opposite to that where the above backing layer is formed.

The above colorant layer is constituted of, for example, a colorant, a binder, etc.

As the colorant, any desired colorant generally used in the field of recording and copying such as pigments (e.g. carbon black) or various dyes may be employed. As the binder, paraffins having various melting points, carunauba wax, beeswax, canderilla wax, low molecular weight petroleum resins, high molecular weight polymers such as polystyrene, styrene-butadiene copolymers, cellulose esters such as ethyl cellulose, cellulose acetate butyrate, etc. can be used.

The colorant layer may also contain, in addition to the above colorant and binder, surfactants, low resistance treating agents, polymeric electrolyts, inorganic salts, etc.

The colorant layer may have a thickness generally of 15 μm or less (preferably 1 to 15 μm).

According to the present invention, a resin composition for heat-sensitive transfer recording medium and a heat-sensitive transfer recording medium having the following advantages can be provided.

(1) The resin composition for heat-sensitive transfer recording medium has sufficient heat resistance for coating treatment of a colorant layer on the opposite surface after coating of the surface of a support.

(2) The heat-sensitive transfer recording medium utilizing the resin composition for heat-sensitive transfer recording medium as the backing layer is free from generation of blocking phenomenon between the backing layer and the colorant layer even when stored for a long term under wound state. Accordingly, even when used after storage of the heat-sensitive transfer recording medium for a long term, the heat-sensitive transfer recording medium can be withdrawn smoothly from the wound state to effect image printing with a thermal head smoothly, and yet there is no generation of sticking phenomenon.

(3) During image printing with a thermal head, in spite of sliding contact of the backing layer of the heat-sensitive transfer recording medium with the thermal head, the surface of the thermal head is not contaminated. Besides, there is no generation of sticking phenomenon.

(4) The resin composition for heat-sensitive transfer recording medium used as the backing layer has no migratability and therefore, even when the heat-sensitive transfer recording medium may be stored for a long term, in spite of contact of the colorant layer with the backing layer, sharp printed image without transfer irregularity or printed image defect can be transferred.

(5) Also, when the silicone resin has a softening point of 60° C. or higher, no polyisocyanate is required to obviate cure aging, whereby the production cost can be lower and, if a resin layer is to be formed on the support with the use of an aqueous solvent, the heat-sensitive transfer recording medium can be produced more cheaply and under safe environment with ease.

EXAMPLES 1 to 5

Seventy (70) parts of a methyl ethyl ketone solution (conc. 2%) of a polyester ["Byron 200" (trade name), produced by Toyobo K.K.] and 30 parts of a toluene solution (conc. 2%) of an organopolysiloxane [softening point 98° C., "SP 2105 (product name), produced by Dainichi Seika K.K.] were mixed to prepare a coating solution A.

Seventy (70) parts of a methyl ethyl ketone solution (conc. 2%) of a nitrocellulose and 30 parts of a toluene solution of an organopolysiloxane [it is in a solution state at the ordinary temperature, "R-7" (product name, produced by Nippon Shokubai K.K.]were mixed to prepare a coating solution B.

Thirty (30) parts of a solution (conc. 2%) of a polyorganosiloxane [softening point 86° C., "SP-203V"(trade name), produced by Dainichi Seika K.K.] in a ketone/toluene solvent mixture (1/1 volume ratio) and 70 parts of a solution (conc. 2%) of a polyamide ["Sanmide #615A" (product name), produced by Sanwa Kagaku K.K.] in an isopropyl alcohol/toluene solvent mixture (8/2 volume ratio) were mixed to prepare a coating solution C.

Fifteen (15) parts of a methyl ethyl ketone solution (conc. 2%) of a silicone modified urethane resin (softening point 64° C., 15% silicone modified) and 85 parts of a methyl ethyl ketone solution (conc. 2%) of a polyester resin ["Byron 200" (product name) produced by Toyobo K.K.] were mixed to prepare a coating solution D.

Fifteen (15) parts of a methyl ethyl ketone solution (conc. 2%) of a silicon modified urethane resin (15% silicone modified), 60 parts of a methyl ethyl ketone solution (conc. 2%) of a polyester resin ["Byron 200"(product name), produced by Toyobo K.K.] and 25 parts of a toluene solution (conc. 2%) of a polyethyleneimine octadecyl alcohol as the resin were mixed to prepare a coating solution E.

On the other hand, previously, a colorant layer composition having the composition shown below was molten by being maintained at a temperature of 120° C and then the colorant layer composition was applied by a wire bar on a polyester film with a thickness of 3.5 μm to a film thickness of 3.5 μm.

| | |
|---|---|
| Carunauba wax | 40 parts |
| Wax (paraffin wax 155 F) | 40 parts |
| Ethylene-acrylate copolymer resin | 5 parts |
| Carbon black | 15 parts |

Subsequently, the above coating solutions A to E were each applied on the surface of the film opposite to that where the colorant layer was coated to a film thickness of 0.15 μm and dried to form a backing layer. Each heat-sensitive transfer recording medium obtained was evaluated by performing blocking test, sticking test, storage test and heat resistance test as described below.

The results are shown in Table 1.

Blocking Test

Heat-sensitive transfer recording medium was wound around a core with an outer diameter of 17 mm under a tension of 5 g per 1 mm width, placed in an atmosphere of 55° C. for 3 days and thereafter the difference in winding out torque by blocking while winding out the medium.

| Meanings of the symbols in Table 1: | |
|---|---|
| ◎ | backing layer and colorant layer are not bound to each other at all; |
| ○ | backing layer and colorant layer are slightly bound to each other; |
| x | backing layer and colorant layer are bound to each other, and winding-out is difficult |

Sticking Prevention Test

Recording was effected on heat-sensitive transfer recording medium by use of a thermal heat with an element density of 8 lines/mm under the conditions of an application voltage of 0.7 W per one heating element and an application time of 2.3 mm sec., and printing quality and sticking prevetive effect were observed.

| Meanings of the symbols in Table 1: | |
|---|---|
| ◎ | no breaking at all on the polyester film which is the support; |
| ○ | slight damage occurred on the polyester film; |
| x | polyester film was broken. |

Storage Test

After storage under the same conditions as in Blocking Test, printing was performed by a commercially available word processor.

The defects in the printed letters were noted for evaluation of printing quality.

| Meanings of the symbols in Table 1: | |
|---|---|
| ◎ | one dot pattern (checker flag) was reproduced; |
| ○ | sharp printing without defect in the printed letters; |
| x | difficult to read with much defects in the printed letters. |

Heat Resistance Test

Backing layer of heat-sensitive transfer recording medium was brought into contact with the surface of a hot roll heated to 100° C., and the extent of adhesion of backing layer onto the hot roll surface was evaluated.

| Meanings of Symbols in Table 1: | |
|---|---|
| ◎ | no adhesion of backing layer at all onto the surface of hot roll; |
| ○ | backing layer slightly adhered onto the surface of hot roll; |
| x | backing layer excessively adhered onto the surface of hot roll. |

COMPARATIVE EXAMPLES 1 to 5

In place of the coating solutions in Examples, the following coating solutions F to J were prepared and, except for using each of the coating solutions F to J, heat-sensitive transfer recording medium was obtained in the same manner as in the above Examples.

Coating solution F: a solution (conc. 2%) of a polyester resin ["Byron 200" (trade name), produced by Toyobo K.K.]in a methyl ethyl ketone/toluene solvent mixture (1/1 volume ratio).

Coating solution G: a methyl ethyl ketone solution (conc. 2%) of a polyorganosiloxane ["SP 212V" (product name), produced by Dainichi Seika K.K.].

Coating solution H: a n-hexane solution (conc. 2%) of a polyorganosiloxane ["X-62-2112" (product name), produced by Shinetsu Kagaku Kogyo K.K.].

Coating solution I: a mixture of 50 parts of a solution (conc. 2%) of a polyester resin ["Byron 200" (trade name), produced by Toyobo K.K.] in a solvent mixture of methyl ethyl ketone/toluene solvent mixture (1/1 volume ratio) and 50 parts of a toluene solution of a paraffin wax ["Paraffin 155" (product name), produced by Kanto Kagaku].

Coating solution J: a methyl ethyl ketone solution of nitrocellulose (conc. 2%).

Each of these heat-sensitive transfer recording media was evaluated by performing blocking test, sticking test, storage test and heat resistance test similarly as described in the above Examples.

The results are shown in Table 1.

TABLE 1

| | Kind of coating solution | Blocking test | Sticking test | Storage test | Heat resistance test |
|---|---|---|---|---|---|
| Example 1 | A | ○ | ○ | ○ | ○ |
| Example 2 | B | ○ | ○ | ○ | ○ |
| Example 3 | C | ○ | ○ | ○ | ○ |
| Example 4 | D | ○ | ○ | ○ | ○ |
| Example 5 | E | ◎ | ○ | ○ | ○ |
| Comp. Exa. 1 | F | x | x | ◎ | ◎ |
| Comp. Exa. 2 | G | ○ | ○ | x | ○ |
| Comp. Exa. 3 | H | ○ | ○ | x | ○ |
| Comp. Exa. 4 | I | x | ○ | ◎ | x |
| Comp. Exa. 5 | J | x | x | ◎ | ◎ |

EXAMPLE 6

A 2% solution (in methyl ethyl ketone/toluene:6/4) of a polyester resin ["Byron 200" (trade name), produced by Toyobo K.K.] and a silicone-containing polymer [SP-203V (trade name), produced by Dainichi Seika Kogyo K.K.] at a mixing ratio of 3/7 (weight ratio) was prepared. Into this solution were added, immediately before coating, a polyisocyanate compound [aromatic polyisocyanate compound, Coronate L (trade name), produced by Nippon Polyurethane K.K.] in an amount of 1% by weight as calculated on soids to prepare coating solution for backing layer of a heat-sensitive transfer recording medium.

The coating solution was applied on a polyester film with a thickness of 3.5 μm to a dried film having a thickness of 0.62 μm and left to stand in a thermostat tank of 50° C. for 48 hours.

Next, on the support surface where no backing layer as mentioned above is provided, a colorant layer composition having the composition shown below was molten by being maintained at 120° C. and applied by a wire bar to a coating thickness of 3.5 μm.

| | |
|---|---|
| Carunauba wax | 40 parts |
| Wax (paraffin wax 155 F) | 40 parts |
| Ethylene-acrylate copolymer | 5 parts |
| Carbon black | 15 parts |

The raw fabric obtained was slitted into ¼inch width, wound around a core with an outer diameter of 17 mm to length of 95 mm to obtain a heat-sensitive transfer recording medium of the present invention.

EXAMPLES 7 to 10

Heat-sensitive transfer recording media of the present invention were prepared in the same manner as in Example 6 except for changing the amount of the polyisocynate compound as follows:

5% by weight (Example 7),
10% by weight (Example 8),
30% by weight (Example 9) and
50% by weight (Example 10).

Evaluation

For the heat-sensitive transfer recording media obtained in Examples 6 to 10, storage test and environmental printing test were conducted, and printing quality and running performance were evaluated.

Storage Test: After the heat-sensitive transfer recording medium obtained was left to stand in an atmosphere of a temperature of 50° C. and a humidity of 80% for 3 days, running performance in a casette was measured by use of a torque meter.

In Table 2, evaluation of running performance of the storage test was as follows:

| | |
|---|---|
| ○ | good running performance exhibited; |
| Δ | no trouble in running, but meandering of ribbon is observed after printing; |
| x | running is unstable. |

Environmental Printing Test: By use of a printer having a thermal head with an element density of 8 lines/mm (application voltage per one heating element 0.7 W, application time of 2.3 mm sec.), whole printing was effected to ribbon length of 95 mm on TRW-7 paper (produced by Jujo Seishi K.K.) under the conditions of a temperature of 40° C. and a humidity of 50%, and printing quality and running performance were evaluated.

The results are shown in Table 2.

In Table 2, evaluation of environmental printing test was performed as follows:

| | |
|---|---|
| ○ | good printing quality was obtained without stopping, etc. being observed during running; |
| Δ | printing is possible, but delays of reeling and peeling of ribbon were caused; |
| x | printing quality was good, but running becomes impossibles at the final stage of wind-up. |

TABLE 2

| | Storage test | | Environmental |
|---|---|---|---|
| | Torque (g · cm) | Running performance | printing test |
| Example 6 | 35 or less | ○ | ○ |
| Example 7 | 28 or less | ○ | ○ |
| Example 8 | 31 or less | ○ | ○ |
| Example 9 | 30 or less | ○ | ○ |
| Example 10 | 35 or less | ○ | ○ |

From Table 2, it can be understood that the heat-sensitive transfer recording medium having a backing layer formed from a composition containing a silicone resin, a polyester resin and a polyisocyanate compound exhibits good running performance and also has good storability.

EXAMPLE 11

A 2% solution (in methyl ethyl ketone/toluene:6/4) of a nitrocellulose ["Cellnova BTH1/2" (trade name), produced by Asahi Kasei K.K.] and a silicone-containing polymer [a silicone modified urethane resin, SP-2105 (trade name), produced by Dainichi Seika Kogyo K.K.] at a mixing ratio of 5/5 (weight ratio) was prepared. Into this solution, immediately before coating, were added a polyisocyanate compound [an aromatic polyisocyanate compound, Coronate L (trade name), produced by Nippon Polyurethane K.K.] in an amount of 10% by weight as calcualated on solids to prepare a coating solution for backing layer of a heat-sensitive transfer recording medium.

The coating solution was applied on a polyester base with a thickness of 3.5 μm by use of a wire bar to a dried film thickness of 0.15 μm, and left to stand in a thermostat tank of 50° C. for 48 hours.

Subsequently, on the support surface where no backing layer as mentioned above was provided, a colorant layer composition having the composition shown below was molten by being maintained at 120° C. and applied by a wire bar to a coating thickness of 3.5 μm.

| | |
|---|---|
| Paraffin wax (m.p. 68° C.) | 44 parts |
| Polyester wax (m.p. 64° C.) | 11 parts |
| Ethylene-acrylate copolymer | 15 parts |
| Diacaruna 30 (produced by Mitsubishi Kasei K.K.) | 15 parts |
| Carbon black | 15 parts |

The raw fabric obtained was slitted into ¼inch width and wound up around a core with an outer diameter of 17 mm to obtain a heat-sensitive transfer recording medium of both present invention.

EXAMPLES 12 to 17

The heat-sensitive transfer recording media of the present invention were prepared in the same manner as in Example 11, except for using, in place of Coronate L, respectively the same amount of:

[EXAMPLE 12]

Duranate 24A-100 (produced by Asahi Kasei K.K.),

[EXAMPLE 13]

IPDI (produced by Huls Co.),

[EXAMPLE 14]

TODI (produced by Mitsui Nisso Urethane K.K.),

[EXAMPLE 15]

Coronate H (produced by Nippon Polyurethane K.K.),

[EXAMPLE 16]

Mixture of equal amounts of TODI and Coronate L, and

[EXAMPLE 17]

Coronate L and curing accelerator (amount used: 1% by weight as solid component based on Coronate L).

Evaluation

For the heat-sensitive transfer recording media obtained, storage test and environmental printing test were conducted in the same manner as described above.

The results are shown in Table 3.

TABLE 3

| | Storage test | | Environmental |
|---|---|---|---|
| | Torque (g · cm) | Running performance | printing test |
| Example 11 | 20 or less | ○ | ○ |
| Example 12 | 30 or less | ○ | ○ |
| Example 13 | 21 or less | ○ | ○ |
| Example 14 | 23 or less | ○ | ○ |
| Example 15 | 27 or less | ○ | ○ |
| Example 16 | 30 or less | ○ | ○ |
| Example 17 | 25 or less | ○ | ○ |

From Table 3, it can be understood that the heat-sensitive transfer recording medium having a backing layer formed from a composition containing a silicone resin, a cellulose type resin and a polyisocyanate compound exhibits good running performance and also good storability.

COMPARATIVE EXAMPLES 6 to 12

In place of the coating solutions in Example 6, the following coating solutions were prepared and, except for using each of the coating solutions, heat-sensitive transfer recording medium was obtained in the same manner as in the Example 6.

[COMPARATIVE EXAMPLE 6]

A solution (conc. 2%) of a polyester resin ["Byron 200"(trade name), produced by Toyobo K.K.] in a methyl ethyl ketone/toluene solvent mixture (1/1 volume ratio).

[COMPARATIVE EXAMPLE 7]

A methyl ethyl ketone solution (conc. 2%) of a polyorganosiloxane ["SP 212V" (product name), produced by Dainichi Seika K.K.].

[COMPARATIVE EXAMPLE 8]

A n-hexane solution (conc. 2%) of a polyorqanosiloxane ["X-62-2112" (product name), produced by Shinetsu Kagaku Kogyo K.K.].

[COMPARATIVE EXAMPLE 9]

A mixture of 50 parts of a solution (conc. 2%) of a polyester rsin ["Byron 200" (trade name), produced by Toyobo K.K.] in a solvent mixture of methyl ethyl ketone/toluene solvent mixture (1/1 volume ratio) and 50 parts of a toluene solution of a paraffin wax ["Paraffin 155" (product name), produced by Kanto Kagaku K.K.].

[COMPARATIVE EXAMPLE 10]

A methyl ethyl ketone solution of nitrocellulose (conc. 2%).

[COMPARATIVE EXAMPLE 11]

A solution (conc. 2%) of a polyester resin ["Byron 200" (trade name), produced by Toyobo K.K.] in a methyl ethyl ketone/toluene solvent miture (1/1 volume ratio).

[COMPARATIVE EXAMPLE 12]

A toluene solution of a poly(N-stearoylethyleneimine).

Evaluation

For each of these heat-sensitive transfer recording media, storage test and environmental printing test were conducted similarly as described above.

The results are shown in Table 4.

TABLE 4

| | Storage test | | Environmental |
|---|---|---|---|
| | Toruque (g · cm) | Running performance | printing test |
| Comp. Exa. 6 | 55 or less | x | x |
| Comp. Exa. 7 | 65 or less | x | x |
| Comp. Exa. 8 | 60 or less | x | x |
| Comp. Exa. 9 | 55 or less | x | Δ |
| Comp. Exa. 10 | 50 or less | Δ | x |
| Comp. Exa. 11 | 50 or less | Δ | x |
| Comp. Exa. 12 | 55 or less | x | x |

EXAMPLES 18 to 22

In place of the coating solutions in Examples 1 to 5, the following coating solutions K to O were prepared and, except for forming backing layers by use of the coating solutions K to 0, heat-sensitive transfer recording media were obtained in the same manner as in the above Examples.

Coating solution K: a mixture of 90 parts of a solution (conc. 2%) of a polyester resin ["Byron 200 " (trade name), produced by Toyobo K.K.] in a methyl ethyl ketone/toluene solvent mixture (1/1 volume ratio) and 10 parts of a solution (conc. 2%) of an organopolysiloxane ["SP 2105" as described above] in a methyl ethyl ketone/toluene solvent mixture (1/1 volume ratio).

Coating solution L: mixture of 90 parts of a methyl ethyl ketone solution (conc. 2%) of a nitrocellulose and 10 parts of a solution (conc. 2%) of an organopolysiloxane ("SP2105" as described above) in a methyl ethyl ketone/toluene solvent mixture (1/1 volume ratio).

Coating solution M: a mixture of the above coating solution L in which 10 parts of the organosiloxane solution were replaced with 10 parts of a solution (conc. 2%) of the polyorganosiloxane ("SP-203 V" as described above in a methyl ethyl ketone/toluene solvent mixture (1/1 volume ratio).

Coating solution N: a mixture of the above coating solution L in which 10 parts of the solution of the organopolysiloxane were replaced with 10 parts of a methyl ethyl ketone solution (conc. 2%) of a silicone resin (it is in a solution state at the ordinary temperature, "KS 776" (trade name, produced by Shinetsu Silicone K.K.).

Coating solution O: a mixture of the above coating soution L in which 10 parts of the solution of organopolysiloxane were replaced with 10 parts of a methyl ethyl ketone solution (conc. 2%) of a silicone resin (it is in a solution state at the ordinary temperature, "SD7226" (trade name, produced by Toray Silicone K.K.).

Evaluation

For the heat-sensitive transfer recording media obtained, storage test was conducted under the conditions as described below.

Storage test: After elapse of 2 months at a temperature of 55° C. and a humidity of 50%, dot reproducibility (25 mJ/head 300 DPI) of a check pattern was compared.

| Meanings of the symbols in Table 5: | |
|---|---|
| ◎ | good reproducibility without defect of dot; |
| ∘ | reproducibility within tolerable range, although defect of dot may be present; |
| Δ | reproducibility outside tolerable range, with defect of dot being present; |
| x | reproducibility outside tolerable range, with defect of dot being present extremely abundantly |

COMPARATIVE EXAMPLES 13 to 16

In place of the coating solutions in Examples 18 to 22, the following coating solutions P to S were prepared, and heat-sensitive transfer recording media were obtained in the same manner as in the above Examples except for forming backing layers by use of the coating solutions P to S, respectively.

Coating solution P: 100 parts of a methyl ethyl ketone/ toluene solution of the same organopolysiloxane as used in the coating solution K.

Coating solution Q: 100 parts of a methyl ethyl ketone/ toluenes solution of the same polyorganosiloxane as used in the coating solution M.

Coating solution R: 100 parts of the same silicone resin as used in the coating solution N.

Coating solution S: 100 prts of the same silicone resin as used in the coating solution O.

For these heat-sensitive transfer recording media, dot reproducibility after storage was evaluated similarly as in the above Examples.

The results are shown in Table 5.

TABLE 5

| | Kind of coating solution | Dot reproducibility |
|---|---|---|
| Example 18 | K | ◎ |
| Example 19 | L | ◎ |
| Example 20 | M | ◎ |
| Example 21 | N | ∘ |
| Example 22 | O | ∘ |
| Comp. Exa. 13 | P | x |
| Comp. Exa. 14 | Q | x |
| Comp. Exa. 15 | R | x |
| Comp. Exa. 16 | S | x |

EXAMPLES 23 to 27 AND COMPARATIVE EXAMPLES 17 to 20

In place of the coating solutions in Exmples 18 to 22 and Comparative examples 13 to 16, the following coating solutions T to AB were prepared, and heat-sensitive transfer recording media were obtained in the same manner as in the above Examples except for forming the backing layers by use of the coating solutions T to AB, respectively.

Coating solution T: Coating solution K, in which 2 parts of the polyisocyanate used in Example 6 were added.

Coating solution U: Coating solution L, in which 2 parts of the polyisocyanate used in Example 6 were added.

Coating solution V: Coating solution M, in which 2 parts of the polyisocyanate used in Example 6 were added.

Coating solution W: Coating solution N, in which 2 parts of a platinum catalyst ["PL-8" (produce name, produced by Toshiba Silicone K.K.) were added.

Coating solution X: Coating solution 0, in which 2 parts of the polyisocyanate used in Example 6 were added.

Coating solution Y: Coating solution P, in which 2 parts of the polyisocyanate used in Example 6 were added.

Coating solution Z: Coating solution Q, in which 2 parts of the polyisocyanate used in Example 6 were added.

Coating solution AA: Coating solution R, in which 2 parts of a platinum catalyst ["PL-8" (product name, produced by Shinetsu Silicone K.K.) were added.

Coating solution AB: Coating solution S, in which 2 parts of a platinum catalyst ["PL-8" (product name, produced by Shinetsu Silicone K.K.) were added.

For the heat-sensitive transfer recording media obtained, the same evaluation as in Examples 18 to 22 was performed to obtain the results as shown in Table 6.

TABLE 6

| | Kind of coating solution | Dot reproducibility |
|---|---|---|
| Example 23 | T | ◎ |
| Example 24 | U | ◎ |
| Example 25 | V | ◎ |
| Example 26 | W | ○ |
| Example 27 | X | ◎ |
| Comp. Exa. 17 | Y | Δ |
| Comp. Exa. 18 | Z | Δ |
| Comp. Exa. 19 | AA | Δ |
| Comp. Exa. 20 | AB | Δ |

We claim:

1. A heat-sensitive transfer recording medium comprising at least one colorant layer containing a heat-fusible substance on one surface of a support, and a backing layer formed from a component (A) wherein component (A) is a silicone modified resin having a softening point of 60° C. or higher and a component (B) wherein component (B) is at least one resin selected from the group consisting of polyester resins, polyamide resins, cellulose resins and acrylic resins provided on a surface of said support where no colorant layer is provided.

2. The heat-sensitive transfer recording medium according to claim 1, wherein said backing layer further contains a polyisocyanate compound.

3. The heat-sensitive transfer recording medium according to claim 1, wherein said component (B) is a cellulose resin.

4. The heat-sensitive transfer recording medium according to claim 3, wherein the celluolse resin is nitrocellulose.

5. The heat-sensitive transfer recording medium according to claim 1, wherein the component (A) and the component (B) are contained each in an amount of 10% by weight or more.

6. The heat-sensitive transfer recording medium according to claim 1, wherein the weight ratio of the component (A) and the component (B) is 80/20 to 10/90.

7. The heat-sensitive transfer recording medium according to claim 1, wherein the silicon modified resin is at least one of a silicone modified urethane resin and a silicone modified acrylic resin.

8. A heat-sensitive transfer recording medium comprising at least one colorant layer containing a heat-fusible substance on a support, and a backing layer formed from a component (A) wherein component (A) is a silicone resin and a component (B) wherein component (B) is at least one resin selected from the group consisting of polyester resins, polyamide resins, cellulose resins and acrylic resins provided on the surface of said support where no colorant layer is provided; and wherein said silicon resin (A) is a silicone modified urethane resin.

9. The heat-sensitive recording medium according to claim 8 wherein said backing layer further comprises a polyisocyanate compound.

10. The heat-sensitive transfer recording medium according to claim 9, wherein said component (B) is a cellulose resin.

11. The heat-sensitive transfer recording medium according to claim 10, wherein said silicone resin (A) has a softening point of 60° C. or higher.

12. The heat-sensitive transfer recording medium according to claim 11, wherein the weight ratio of a urethane resin moiety (X) to a silicone resin moiety (Y) (X:Y) in the silicone modified urethane resin is 99:1 to 5:95.

13. The heat-sensitive transfer recording medium according to claim 12, wherein the component (A) and the component (B) are contained each in an amount of 10% by weight or more.

14. The heat-sensitive transfer recording medium according to claim 13, wherein the cellulose resin is nitrocellulose.

15. The heat-sensitive transfer recording medium according to claim 14, wherein the weight ratio of the component (A) and the component (B) is 80/20 to 10/90.

16. The heat-sensitive transfer recording medium according to claim 8, wherein the weight ratio of a urethane resin moiety (X) to a silicone resin moiety (Y) (X:Y) in the silicone modified urethane resin is 99:1 to 5:95.

17. The heat-sensitive recording medium according to claim 8 wherein the silicone moiety of the silicone modified resin comprises 5 to 40% by weight of the whole resin.

* * * * *